United States Patent [19]

Garner et al.

[11] 4,164,631

[45] Aug. 14, 1979

[54] HORN LOUDSPEAKER WITH ACOUSTIC LENS

[75] Inventors: Alex V. Garner, High Wycombe; Graham Townsend, Chinnor, both of England

[73] Assignee: Tannoy Products Limited, Buckinghamshire, England

[21] Appl. No.: 902,519

[22] Filed: May 3, 1978

[30] Foreign Application Priority Data

May 6, 1977 [GB] United Kingdom ..... 19135/77

[51] Int. Cl.[2] ..... H04R 1/20; H04R 9/06

[52] U.S. Cl. ..... 179/115.5 H; 181/176; 181/191

[58] Field of Search ..... 179/115.5 DV, 115.5 PS, 179/115.5 H, 116; 181/159, 175, 176, 177, 191

*Primary Examiner*—George G. Stellar

*Attorney, Agent, or Firm*—Andrus, Sceales, Starke & Sawall

[57] ABSTRACT

A moving coil loudspeaker of the type including a pair of co-axial speech coils, one for driving a high frequency diaphragm at the rear of the loudspeaker to provide an output along a horn and the other for driving a cone forming a continuation of the horn and reproducing the lower frequencies has an acoustic lens fitted in the region where the horn contour is taken over by the cone, the lens being shaped over its external surface so as to conform snugly with the contour of the cone and being effective to increase the divergence of the beam of acoustic radiation from the horn in the operative plane of the lens. The acoustic lens is preferably so designed that the divergence of the acoustic beam from the horn matches that from the cone and may be of the slant-type, being held by a cruciform mounting extending across the mouth of the horn proper.

5 Claims, 3 Drawing Figures

HORN LOUDSPEAKER WITH ACOUSTIC LENS

BACKGROUND AND SUMMARY OF THE PRESENT INVENTION

This invention relates to moving coil loudspeakers of the type including a pair of co-axial speech coils, one of which drives a high frequency diaphragm at the rear of the loudspeaker to provide an output along a horn and the other of which drives a cone forming a continuation of the horn and reproducing the lower frequencies. An example of such a construction is described and illustrated in British patent specification No. 893,838.

The angle of divergence of a horn is characteristically narrow where the wavelength of the radiated sound is small compared with the horn mouth circumference. As a result over some areas a listener will not hear higher frequencies at the same strength as lower frequencies. This is detrimental to the acoustic reproduction of sounds, and is a well known drawback of this type of loudspeaker construction.

According to the present invention, an acoustic lens is fitted in the region where the horn contour is taken over by the cone, the lens being shaped over its external surface so as to conform snugly with the contour of the cone and being effective to increase the divergence of the beam of acoustic radiation from the horn in the operative plane of the lens. Since, as mentioned above, the cone forms an extension of the horn, the acoustic lens is thus situated within the outer part of the horn. As is well known, such a lens operates by increasing the path length of peripheral radiation in relation to that closer to the axis, thus increasing the curvature of the wave front and hence the divergence of the beam of acoustic radiation in the plane for which the lens is designed and which, in practice, will normally be the horizontal plane. The lens may thus be designed to give any required degree of divergence to the acoustic beam from the horn and this may conveniently match that from the cone.

The acoustic lens is preferably of the slant-plate type, but other types of such lens may be used such as the perforated plate type, for example. Whatever the type of lens, it is conveniently held in position by a cruciform mounting extending across the mouth of the horn proper.

BRIEF DESCRIPTION OF THE DRAWING

A construction of loudspeaker in accordance with the invention will now be described by way of example, with reference to the accompanying drawings, in which.

DETAILED DESCRIPTION OF THE PREFERRED EMBODIMENT

Figure 1:
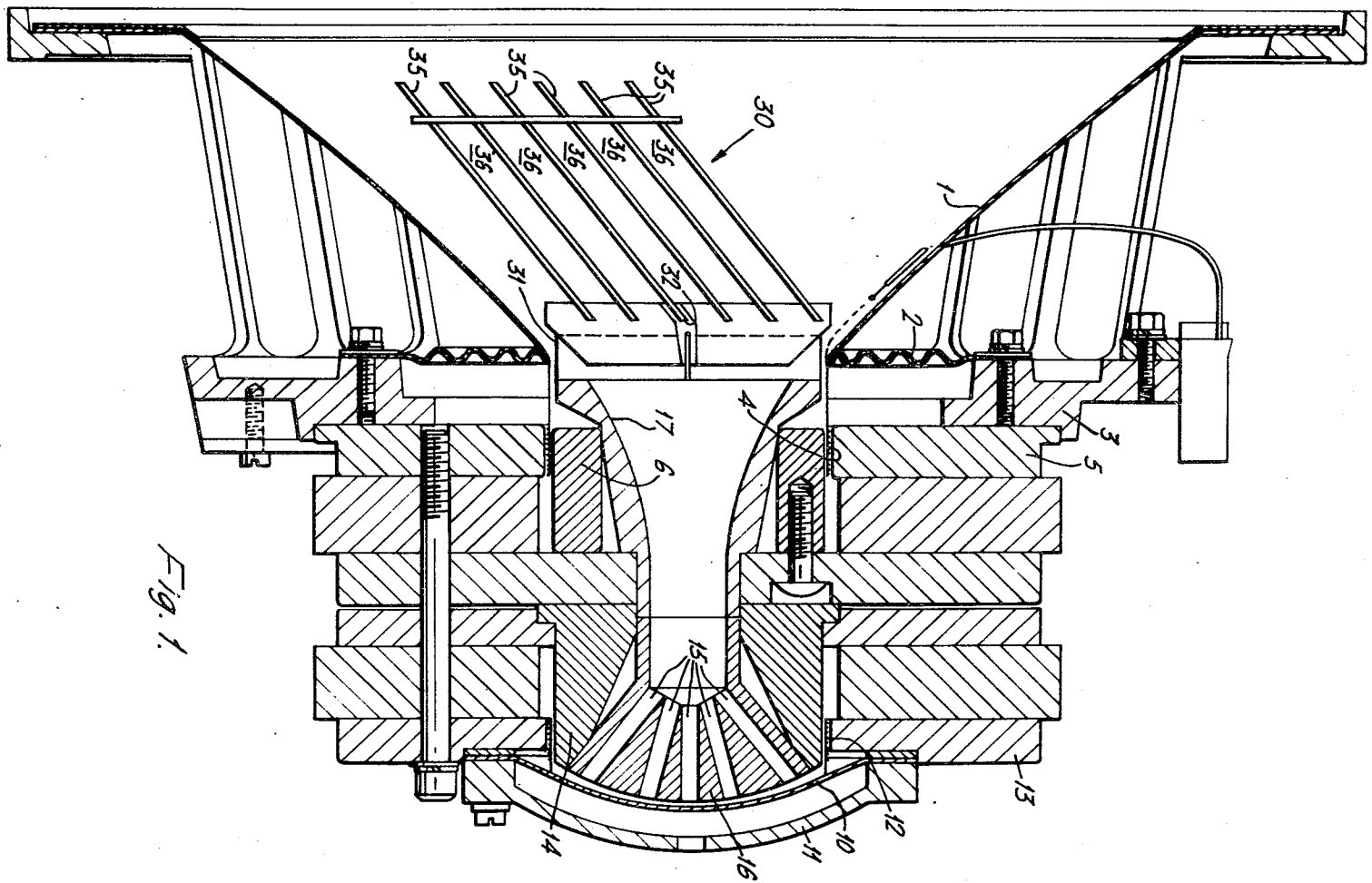
FIG. 1 is a view of the complete loudspeaker seen in longitudinal section.

The basic structure of the loudspeaker is similar to that illustrated in British patent specification No. 893,838 referred to above and since it is described in more detail in the co-pending application Ser. No. 902,516 filed May 3, 1978 it will now be described only relatively briefly. Thus a cone 1 is supported by a surround 2 which is attached at its outer edge to a frame member 3 and the cone is driven by a speech coil 4 working in an air gap between an annular plate 5 and a central cylindrical member 6. Similarly, at the rear of the loudspeaker, a diaphram 10 enclosed by a cover 11 is driven by a speech coil 12 working in an air gap between an annular plate 13 and a cylindrical central member 14. Sound generated by the diaphragm 10 passes along passages 15 in the member 16 and thence along a horn member 17 extending through the centre of the magnetic assembly. As can be seen from FIG. 1 of the drawings, the cone 1 forms an extension of the horn member 17.

The magnetic structure of the loudspeaker is described in detail in the co-pending application referred to above and forms no part of the present invention. The improvement constituting the subject matter of the present invention is constituted by an acoustic lens 30 which, as illustrated, is of the slant-plate type and is held in position by a cruciform mounting 31 to which it is clipped by means of a slotted member 32. The mounting 31 extends across the mouth of the horn member 17 so that the acoustic lens 30 is mounted in the region where the cone 1 takes over the contour of the horn.

Figure 2:
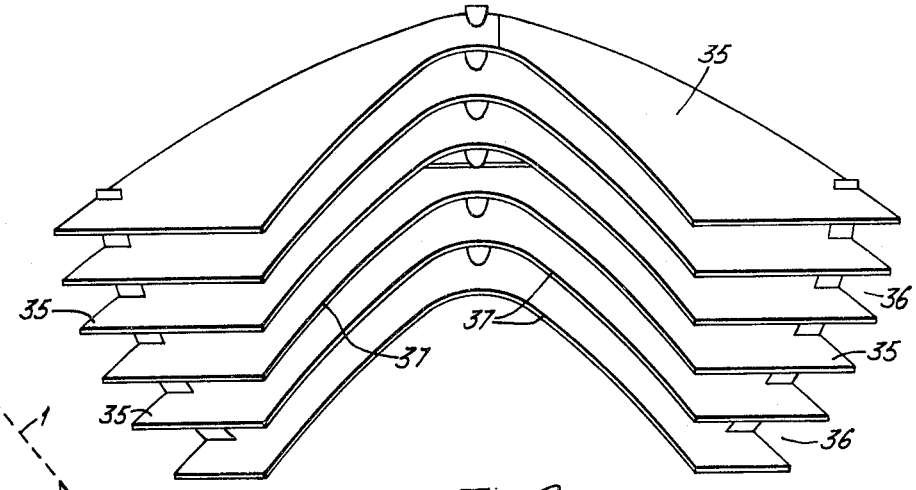
FIG. 2 is a front elevation of an acoustic lens forming part of the construction shown in FIG. 1.
Figure 3:
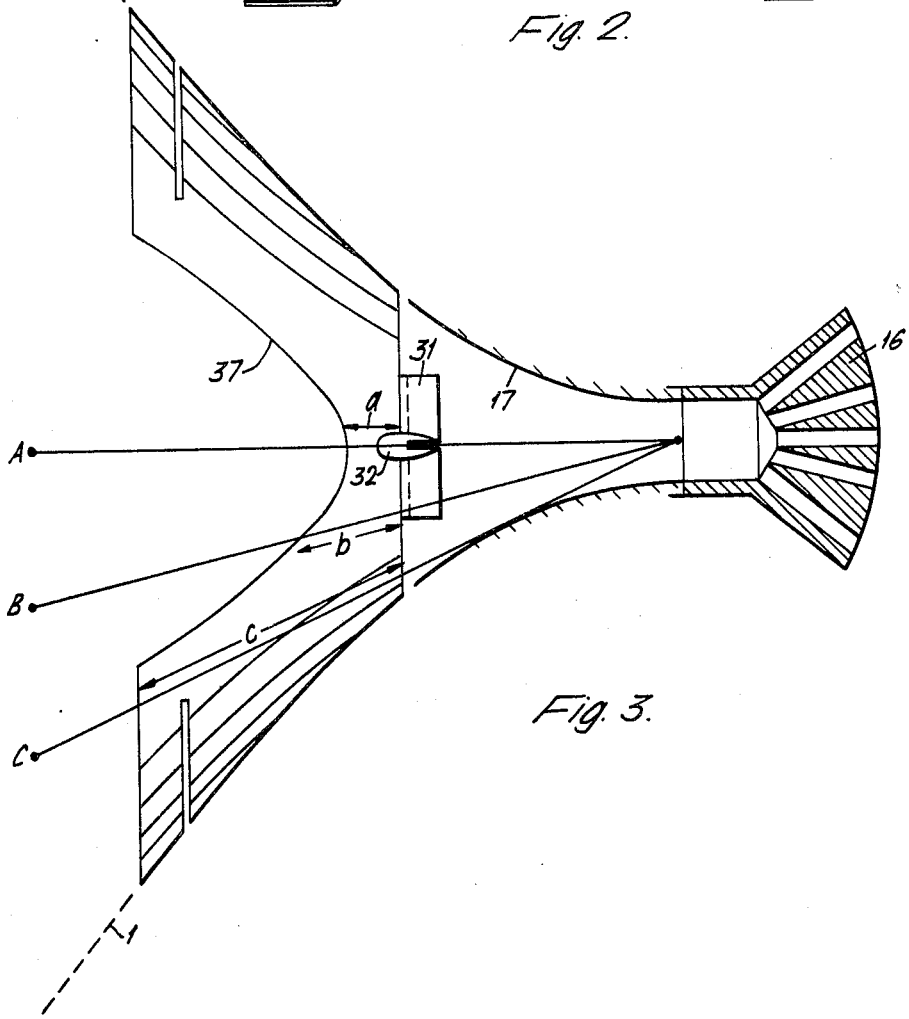
FIG. 3 is a plan view of the lens, illustrating the manner in which it conforms with a cone also shown in FIG. 1 and also showing the outline of the horn.

The lens 30 comprises a series of parallel plates 35 mounted at uniform spacings to define a series of passages 36, best seen in FIG. 1. As best been in FIGS. 2 and 3, the outer edge of each plate 35 is shaped to conform with the cone 1 seen in dotted lines in FIG. 3. The inner edge 37 of each plate 35 has a shape which determines the characteristics of the lens as a whole. The manner in which this is achieved is illustrated in FIG. 3. Thus it will be seen that acoustic radiation from the horn to a point in space on the axis of the horn, shown as A, passes along a relatively short length of each passage defined by the distance a in FIG. 3. Acoustic radiation to a point B passes along an intermediate length of passage indicated at b and, at the other extreme, radiation to a point in space in front of the horn, shown as C, in the plane (normally horizontal) containing the axis but at an angle to the axis, passes along a passage defined by the full dimension c of the plates 35, i.e. the full length of the passages 36 as seen in FIG. 1.

Consequently, to reach a point such as A on the axis, sound from the horn is first deflected away from the axis along the passages 36 and must therefore travel along two sides of a triangle to reach the axis, the extent of the deflection depending on the distance from the centre of the mouth of the horn, e.g. as illustrated by the intermediate point B. Consequently, the radiation towards the edge of the horn is retarded in relation to that at the centre to give the increased curvature of the wave front referred to originally. As just mentioned, the effect obtained occurs in the plane containing the axis of the horn and which, when the loudspeaker is in normal use, is horizontal. In other words, this is the operative plane of the lens in which the described effects occur.

As a consequence of the construction just described, the divergence of the radiation from the horn can, for example, be adjusted to match that of the radiation from the cone without otherwise affecting the characteristics of the loudspeaker as a whole. Thus a substantial improvement is effected in the high frequency dispersion in the operative plane of the lens, i.e. normally in the horizontal plane as just described.

We claim:

1. In a moving coil loudspeaker of the type including a pair of co-axial speech coils, one of which drives a high frequency diaphragm at the rear of the loudspeaker to provide an output along a horn and the other of which drives a cone forming a continuation of the horn and reproducing the lower frequencies, the improvement which comprises an acoustic lens fitted in the region where the horn contour is taken over by said cone, said lens having an external surface shaped so as to conform snugly with the contour of said cone and being effective to increase the divergence of the beam of acoustic radiation from said horn in the operative plane of said lens.

2. A moving coil loudspeaker according to claim 1, in which said acoustic lens is of the slant-plate type.

3. A moving coil loudspeaker according to claim 1 in which said acoustic lens is so designed that the divergence of the acoustic beam from said horn matches that form said cone.

4. A moving coil loudspeaker according to claim 3, in which said acoustic lens is of the slant-plate type.

5. A moving coil loudspeaker according to claims 1, 2, 3, or 4, and further including a cruciform mounting extending across the mouth of said horn proper to hold said acoustic lens.

* * * * *